US006908348B2

(12) United States Patent
Zhao et al.

(10) Patent No.: US 6,908,348 B2
(45) Date of Patent: Jun. 21, 2005

(54) BOX TERMINAL WITH EXTENDED CONTACT SURFACES AND CONTROLLED DAMAGE LOCATION DURING HIGH VOLTAGE ARCING WITH AND WITHOUT SUPPRESSION UNDER A MAGNETIC FIELD

(75) Inventors: Weiping Zhao, Allen Park, MI (US); Robert F. Gutman, Allen Park, MI (US)

(73) Assignee: Alcoa Fujikura Limited, Franklin, TN (US)

( * ) Notice: Subject to any disclaimer, the term of this patent is extended or adjusted under 35 U.S.C. 154(b) by 0 days.

(21) Appl. No.: 10/722,995

(22) Filed: Nov. 26, 2003

(65) Prior Publication Data

US 2004/0106333 A1 Jun. 3, 2004

Related U.S. Application Data

(60) Provisional application No. 60/429,469, filed on Nov. 27, 2002.

(51) Int. Cl.[7] ..... H01R 13/187
(52) U.S. Cl. ..... 439/845; 439/181
(58) Field of Search ..... 438/843, 845, 438/852, 181, 182, 520

(56) References Cited

U.S. PATENT DOCUMENTS 3,813,639 A * 5/1974 Schurter et al. ..... 439/184
3,815,081 A * 6/1974 Jones ..... 439/47
4,104,497 A * 8/1978 Brealey ..... 200/305
5,607,328 A * 3/1997 Joly ..... 439/852
5,951,338 A * 9/1999 Seko et al. ..... 439/843
5,971,816 A * 10/1999 Chaillot ..... 439/852
5,997,327 A * 12/1999 Vergne et al. ..... 439/181
6,390,839 B2 * 5/2002 Miwa ..... 439/181
6,491,532 B1 * 12/2002 Schoepf et al. ..... 439/181
6,616,468 B2 * 9/2003 Sakiyama ..... 439/181
6,761,570 B2 * 7/2004 Patterson et al. ..... 439/188
2003/0211762 A1 * 11/2003 Riku ..... 439/108

* cited by examiner

*Primary Examiner*—Tho D. Ta
*Assistant Examiner*—Larisa Tsukerman
(74) *Attorney, Agent, or Firm*—Tracey D. Beiriger; Eckert Seamans Cherin & Mellott, LLC

(57) ABSTRACT

The present invention relates generally to male to female contact terminals, particularly those in use with associated wire harnesses or cables involved in higher voltage and current carrying vehicle applications. More specifically, the present invention discloses an improved female terminal design for interengaging with a projecting blade of a male terminal and which in particular provides the combined features of improved contact area and controlled blade insertion. Additional features of the present design include the female terminal exhibiting one or more initial (sacrificial) contact points at the blade insertion end and which functions, with or without the application of a magnetic field inducing Lorentz force, to provide a controlled location at which voltage induced arcing will occur along the female terminal and without compromising the electrical interface created between the male terminal blade and the female terminal beams.

11 Claims, 18 Drawing Sheets

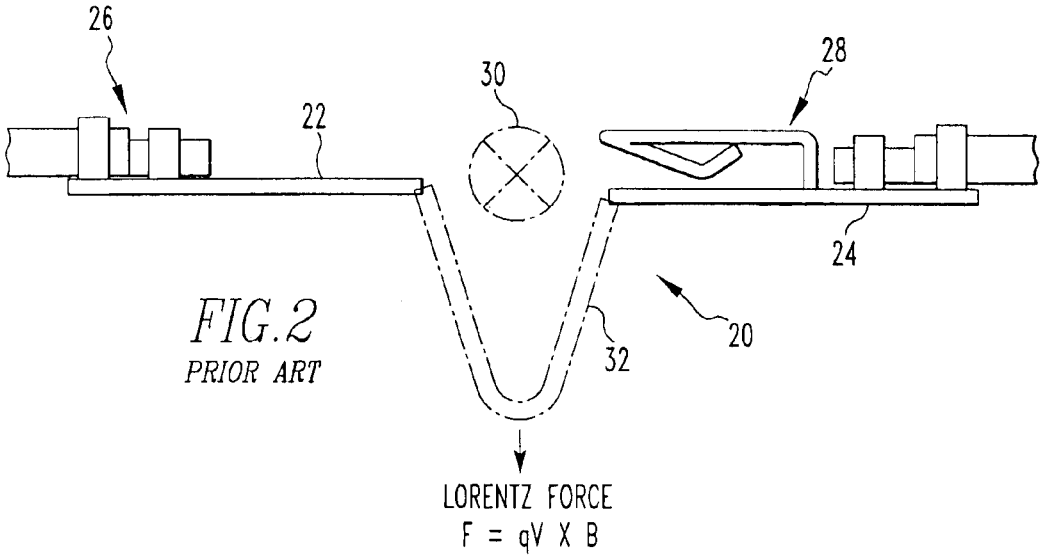
FIG.2
PRIOR ART
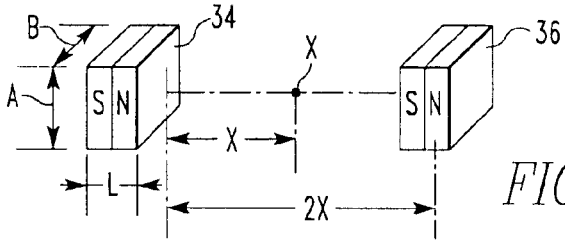
FIG.3a
MAGNETIC FLUX DENSITY AT POINT : 38
$$B(x) = \frac{2Br}{\pi}\left\{\tan^{-1}\frac{AB}{2x\sqrt{4x^2+A^2+B^2}} - \tan^{-1}\frac{AB}{2(L+x)\sqrt{4(L+x)^2+A^2+B^2}}\right\}$$
FIG.3b

BOX TERMINAL WITH EXTENDED CONTACT SURFACES AND CONTROLLED DAMAGE LOCATION DURING HIGH VOLTAGE ARCING WITH AND WITHOUT SUPPRESSION UNDER A MAGNETIC FIELD

CROSS REFERENCE TO RELATED APPLICATIONS

The present application claims priority of U.S. Provisional Application Ser. No. 60/429,469, filed Nov. 27, 2002, and entitled "Box Terminal With Extended Contact Surfaces and Controlled Damage Location During High Voltage Arcing With and Without Suppression Under a Magnetic Field.

FIELD OF THE INVENTION

The present invention relates generally to male to female contact terminals, particularly those in use with associated wire harnesses or cables involved in higher voltage and current carrying vehicle applications. More specifically, the present invention discloses an improved female terminal design for interengaging with a projecting blade of a male terminal and which in particular provides the combined features of improved contact area and controlled blade insertion. Additional features of the present design include the female terminal exhibiting one or more initial (sacrificial) contact points at the blade insertion end and which functions, with or without the application of a magnetic field inducing Lorentz force, to provide a controlled location at which voltage induced arcing will occur along the female terminal and without compromising the electrical interface created between the male terminal blade and the female terminal beams. The sacrificial contact tabs further provide a small area for applying any coatings, such as nickel, ceramic, silver, gold and others, which further reduce the damage resulting from arcing.

BRIEF DESCRIPTION OF THE DRAWINGS

Reference will now be made to the attached drawings, when read in combination with the following detailed description, wherein like reference numerals refer to like parts throughout the several views, and in which:

FIG. 2 is a further diagrammatic and prior art schematic view of a known arc-prevention assembly termed as a magnetic field creating Lorentz force;

FIGS. 3A, 3B and 3C are additional views according to the prior art and which explain the phenomenon associated with the creation of the Lorentz forces;

DETAILED DESCRIPTION OF PREFERRED EMBODIMENTS

Figure 1A:
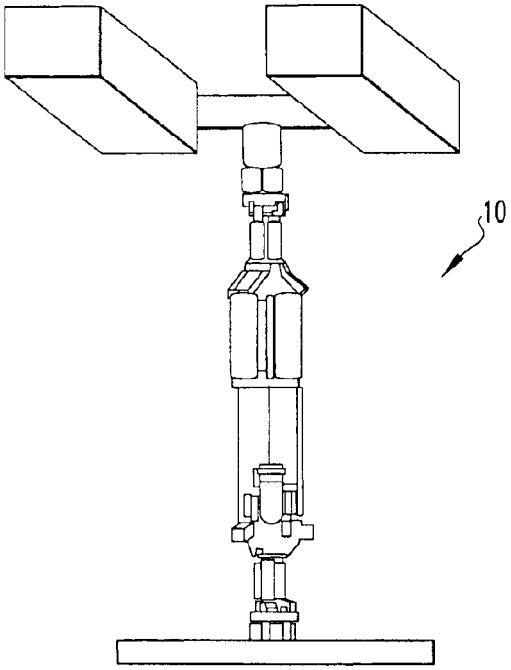
FIG.1a PRIOR ART
FIGS. 1A and 1B are prior art schematic views of before and after conditions of a female to male contact terminal undergoing an arc discharge phenomenon and which results in the damage caused to the terminals.
Figure 1B:
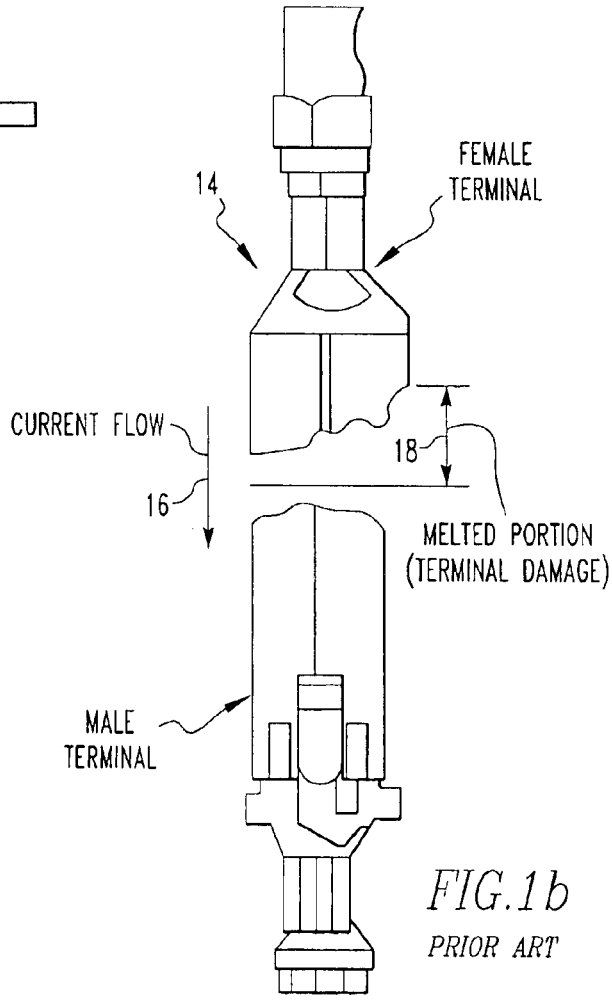
FIG.1b PRIOR ART

Referring now to FIGS. 1A and 1B, a series of environmental views are shown at 10 and 14, according to the known art, and which illustrated, respectively, before and after conditions of a female to male contact terminal undergoing an arc discharge phenomenon. As is known in the art, higher voltages which are associated with such male to female terminal assemblies, and in particular such as vehicle assemblies which require operation at higher (e.g., 42V) operating voltages and which tend to cause arcing across the terminals as a result of an excessive amount of electrical energy (voltage and current), beyond which the terminal design is capable of sustaining and transferring.

As is best illustrated at 14 in FIG. 1B, the by-product of electrical arcing is most typically heat and which can result in melting of a portion of the terminal assembly. The direction of arcing is usually counter to the flow of current, illustrating at 16 in FIG. 1B, and results, in this instance, in a portion 18 of a female interconnecting terminal being melted, thus opening the current path along the terminal assembly.

Referring to FIG. 2, one known attempt at minimizing the likelihood of high voltage arcing is accomplished, as generally shown at 20, by the creation of a lengthened energy flow path between associated gaps in male 22 to female 24 interface terminals (and such as previous or subsequent to engaging contact being established between the terminals 22 and 24). Electric wires (or cables) associated with the male 22 and female 24 terminals are further illustrated at 26 and 28, respectively, and further illustrated schematically is an experimental set-up of a magnetic field 30.

This field 30 is further understood to be created by the placement of a pair of attracting magnets (not shown in this illustration) perpendicular to the location of the male blade and associated female housing and such that a Lorentz force generated and arcing path 32 is created. A Lorentz force is generally calculated, according to the equation $F=qv\times B$, to be the product of the electrical charge (q), the particle travel velocity (v) and the magnetic field direction (B). The furthering advantage of lengthening the arcing path between the associated male and female terminals is to draw as much energy as possible from the energy being transferred and in the attempt to minimize the arcing condition.

Figure 3C:
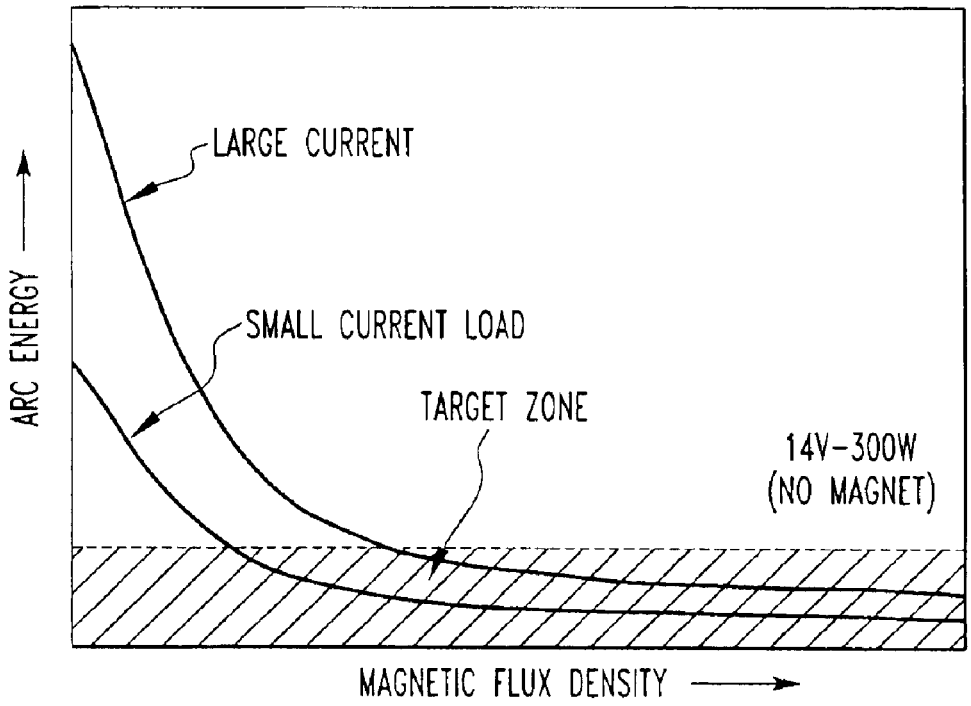
FIG. 3c PRIOR ART

Referring further to FIGS. 3A, 3B and 3C, additional views are provided, again according to the prior art, and which further explain the physical phenomenon associated with the creation of the Lorentz forces. In particular, it is desired to place the magnets, see at 34 and 36 in FIG. 3A, as closely together as possible in order to create the strongest possible magnetic field, and associated arcing path, at the arcing zone between the terminals. Referring to FIG. 3B, the equation is presented at 38 for calculating the magnetic flux density at a given center point X established between the two magnets 34 and 36. Referring further to FIG. 3C, a graph is presented at 40 of arc energy to magnetic flux density variables and for both of large current and small current loads. The graph 40 further seeks to establish a desired target zone (such as for example exists in a 14V-300 W input condition) and within which the creation of an excessive degree of arc energy is avoided.

It has been found that damage occurring at the electrical interface zone, established between a plurality of elongated and angled beams of a female terminal and an associated and inserting male terminal pin or blade (not clearly shown in this illustration), can effectively interrupt the electrical flow path established between the terminals and even in the absence of the catastrophic results achieved in FIG. 1B. This is so because, even in instances in which the overall damage caused by the arcing is small, any such damage occurring between the interengaging male blade/pin and female beams can affect the terminal function. Accordingly, and in view of the fact that such arcing conditions often occur at the main interengaging location between the male and female terminals, it is desirous to both control and redirect any damage resulting from arcing conditions to locations as far as possible remote from this main contact location so that, upon the occurrence of an arcing event, the remaining functionality of the terminal assembly is not impaired.

Figure 4A:
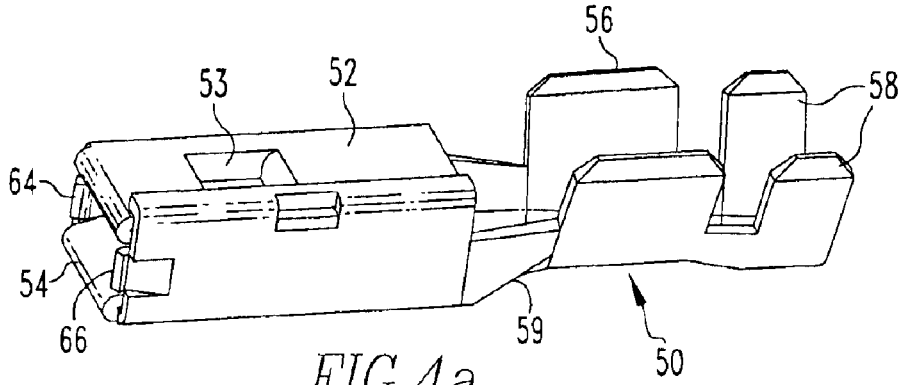
FIGS. 4A, 4B and 4C illustrate first, second and third perspective and rotated views of a female box terminal according to the present invention and for receiving a male terminal insertion blade.
Figure 4B:
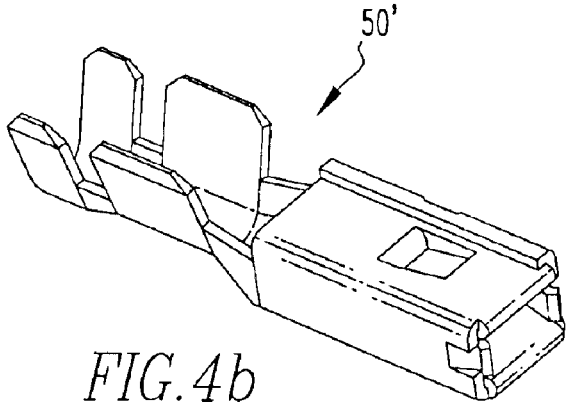
Figure 4C:
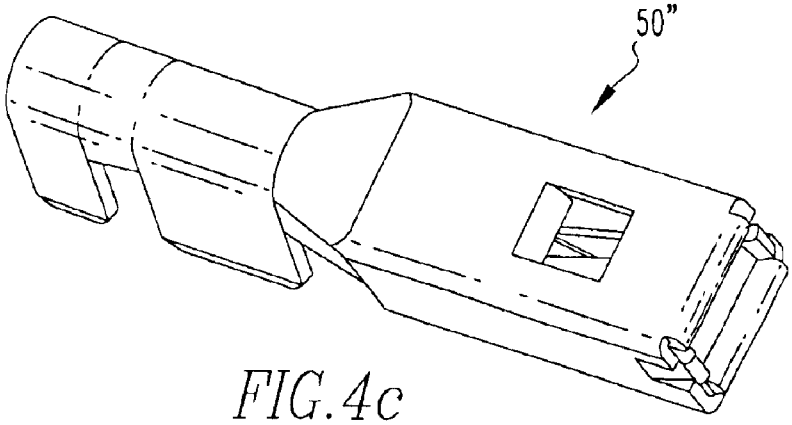

Referring to FIGS. 4A, 4B and 4C a series of first 50, second 50' and third 50" perspective and rotated views are illustrated of a female box terminal according to a first preferred embodiment of the present invention. The female box (rectangular) terminal 50 is particularly suited for receiving, in inserting and interengaging fashion, a male insertion blade (not shown) of an associated. As best illustrated in FIG. 4A, the female terminal includes a forwardly directed, elongated and rectangular shaped cage portion 52 terminating in an open inserting end 54. One or more locking windows 53 are located through a selected face or faces of the terminal cage portion 52 and are intended to interengage with suitable sidewise projecting structure (not shown) associated with the male terminal and in order to maintain the engaged relationship between the male and female terminals. Pairs of cable gripping portions, see at 56 and 58, are provided for engaging over an exposed end of a suitable cable or wire (see again at 26 and 28 in FIG. 2) and extend from an interconnecting portion 59 of the main cage portion 52.

Figure 5A:
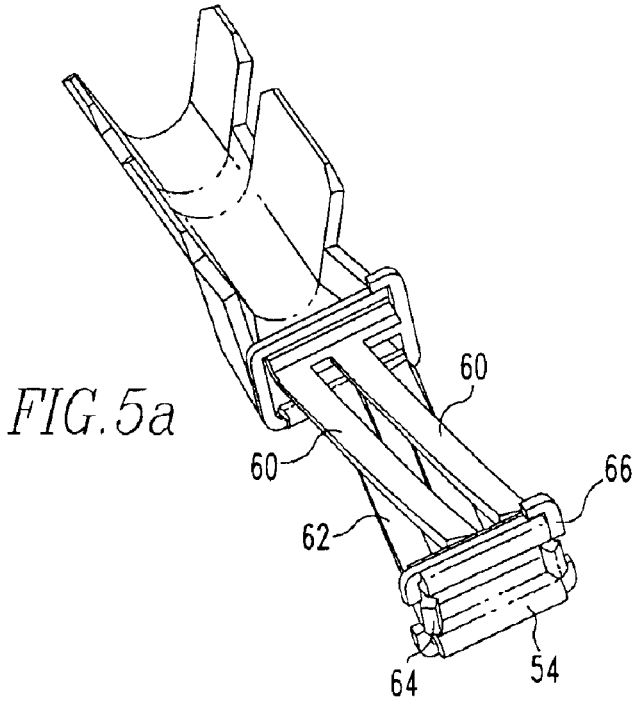
FIGS. 5A and 5B are first and second partially cutaway and rotated perspective views of the box terminal as shown in FIGS. 4A–4C and which illustrate the configuration of the angled and torsioned beams with the further removal of the outer rectangular cage portion.
Figure 5B:
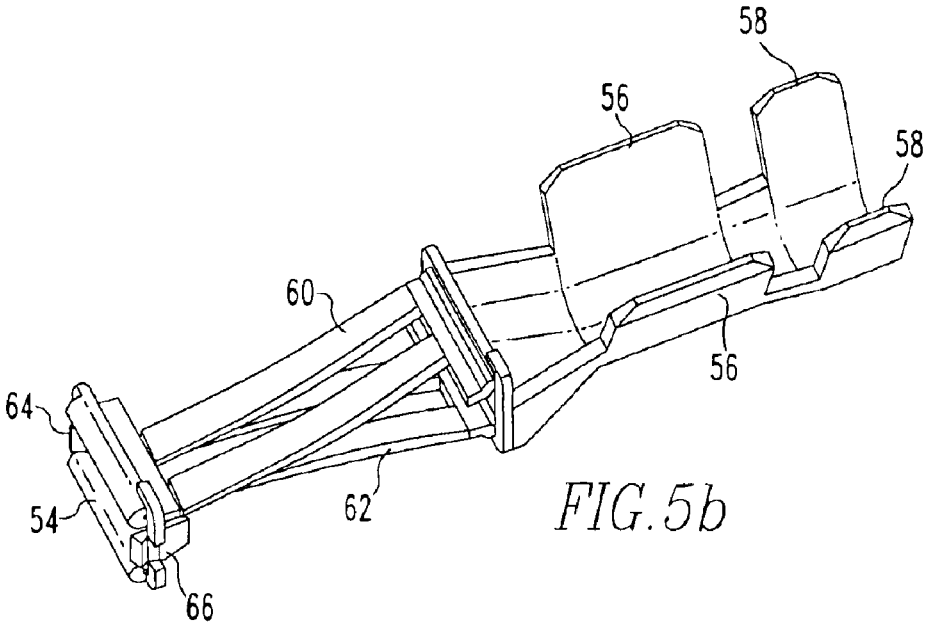

As best further shown in the partial cutaway illustrations of FIGS. 5A and 5B, first and second pairs of angled and torsioned beams 60 and 62 are revealed inside of the rectangular cage portion 52 (again removed for purpose of these illustrations). The configuration of the beams 60 and 62 is such that, upon inserting engagement of the male blade through the open end 54 of the female terminal, the beams 60 and 62 provide the combined features of increased contact area with respect to the male blade, while at the same time providing reduced insertion forces concurrent with providing increased normal (perpendicular) directed holding forces of the male blade.

Figure 6:
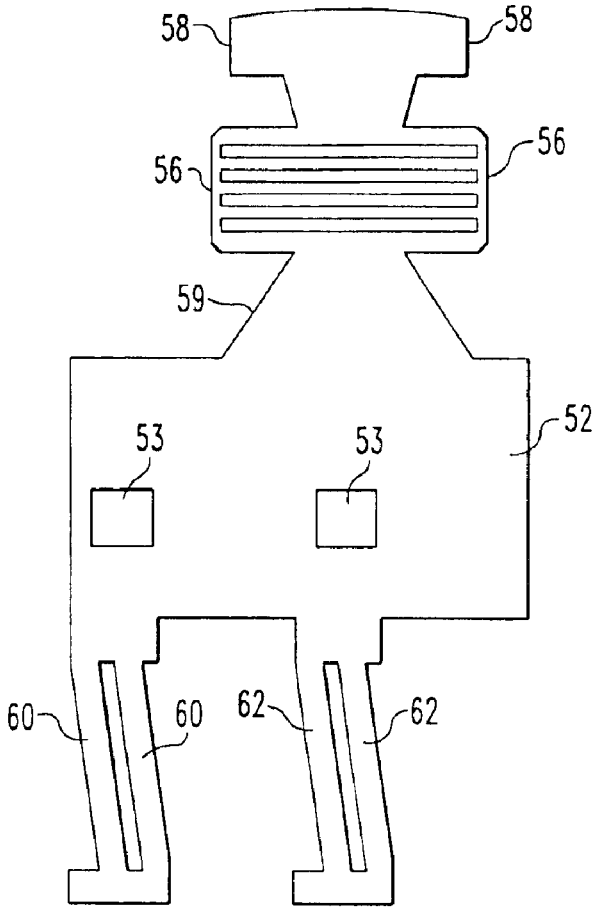
FIG. 6 is a plan view of a one-piece and configurable blank associated with the female terminal according to the present invention.

It has further been found that male blade insertion forces are affected by both the deflection of the beam along its longitudinal direction, combined with torsional deflection in a perpendicular direction. As is also shown in FIG. 6, the female terminal can be constructed from a one-piece blank design and which is bent and manipulated according to a suitable manufacturing process in order to achieve the completed shape shown in FIGS. 4A–4C.

Figure 7:
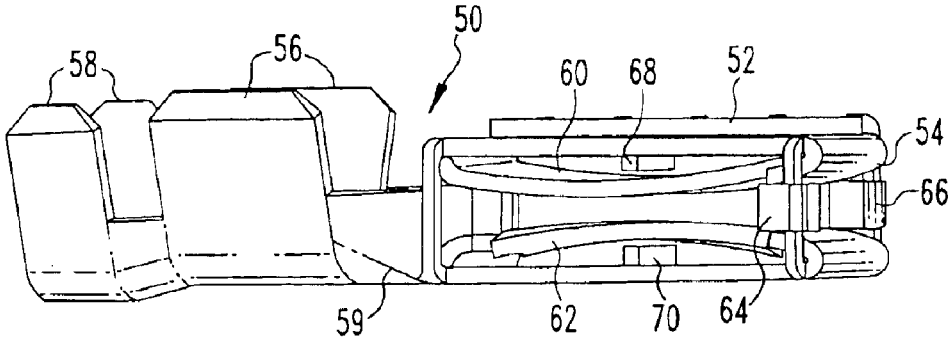
FIG. 7 is an enlarged side presented perspective view, in partial cutaway, and which more clearly illustrates the features of the forwardly positioned and sacrificial contact tabs associated with the insertion end of the female terminal, combined with the intermediate located and opposingly arrayed overstress protection ribs and against which the angled beams abut during male blade insertion.

Referring now to FIG. 7, an enlarged side presented perspective view is shown, again with the outer layer of the rectangular cage portion 52 in cutaway, of the female terminal. More clearly illustrated in FIG. 7 is the feature of a pair of forwardly positioned and sacrificial contact tabs, see at 64 and 66 and as is also shown in FIGS. 4A and 5A, associated with the insertion end 54 of the female terminal. The contact tabs 64 and 66 provide an initial contact point between the female terminal and the associated male terminal during their interengagement (as well as a final point of contact during reverse disengagement).

It is the intended feature of the contact tabs 64 and 66 to provide a remote location, away from the electrical interface established between the contact beams 60 and 62 and the associated and interengaging male terminal blade (on sides of male terminal, not shown in this illustration) for accommodating and receiving an electrical arcing event and as has been previously described. In this manner, the integrity of the electrical interface established between the contact beams 60 and 62 and the male blade can most likely be saved in favor of sacrificing the initial contact tabs 64 and 66.

As will be further explained in reference to subsequent variants, any number of contact tabs (or even a single tab) can be located at the open inserting end and can adequately function to provide an arcing bridge away from the main electrical interface. It is further desired that the surfaces of the contact tabs 64 and 66 can be coated with a suitable and arcing-resistant material, such as may further include coatings of nickel, ceramic, silver, gold, among others, and in an attempt to further elevate the threshold at which an arcing event will occur. It is also important to note that the configuration of the female terminal with the sacrificial contact tabs, can be utilized both with and without the Lorentz force inducing magnets and within the scope of the present invention.

Referring again to FIG. 7, an additional feature of the female terminal is the provision of a pair of contact ribs 68 and 70 which extend in laterally extending, inwardly projecting and opposing fashion from opposing interior walls of the rectangular cage portion 52. Upon insertion of the male blade, the angled beams 60 and 62 are engaged and biased outwardly into an abutting contact with the ribs 68 and 70. At this point, the ribs 68 and 70 protect against overstressing the elongated beams 60 and 62 during blade insertion. Additionally, it has been found that at least one of the ribs 68 and 70 function to provide a secondary benefit of conducting current through the main electrical interface.

Figure 8:
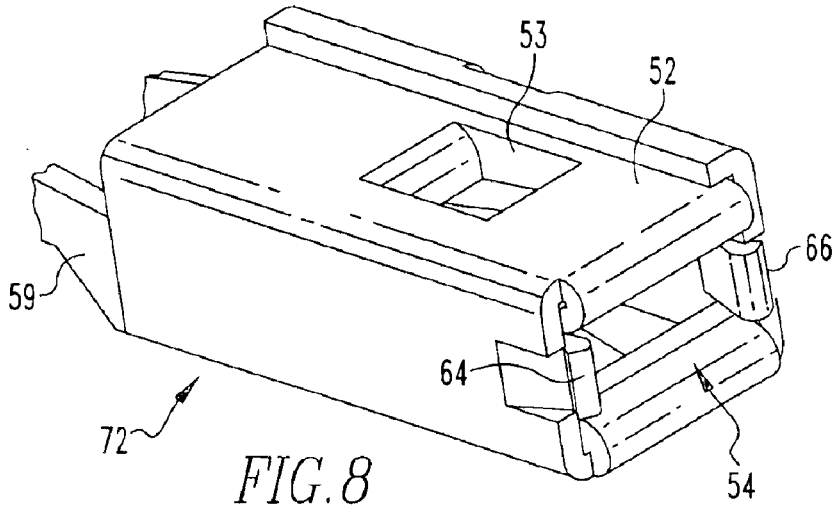
FIG. 8 is an enlarged perspective view of the open insertion end associated with the female terminal according to the present invention.

Having undertaken an explanation of the female terminal design according to FIGS. 4A–7, reference will now be made to the succeeding figures and which illustrate various assembly arrangements of the female terminal according to the present invention, in combination with an appropriately configured and interengageable male terminal and the Lorentz force inducing magnets. Referring to FIG. 8, an enlarged perspective view is illustrated at 72 of the forward inserting end of the female terminal, as substantially previously described and which again includes such features as the rectangular spring cage portion 52, locking window 53, open inserting end 54 and configured pre-engagement tabs 64 and 66.

Figure 9A:
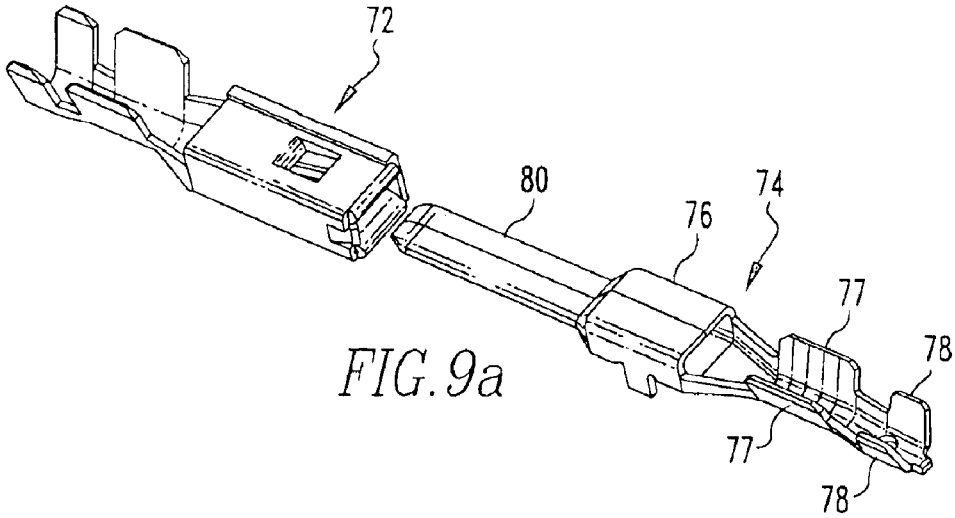
FIGS. 9A and 9B are perspective and cutaway schematic views of a pre-engagement position established between the female terminal and an associated male terminal according to the present invention.
Figure 9B:
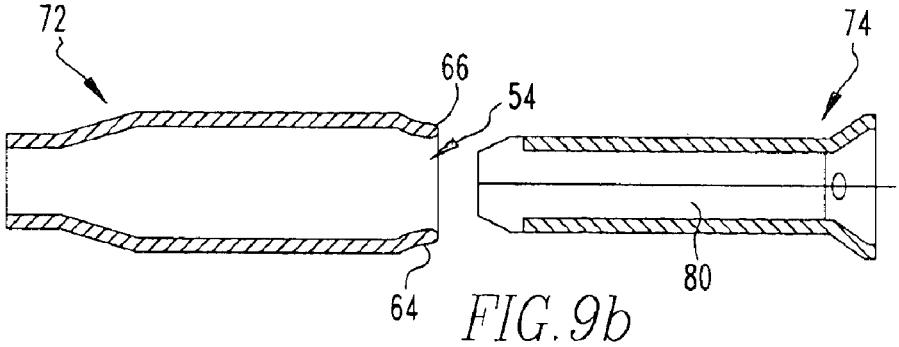

Referring further to FIGS. 9A and 9B, perspective and cutaway views are respectively shown of a pre-engagement position established between the female terminal 72 and an associated male terminal 74. As previously discussed, the male terminal 74 is constructed so that it likewise includes a main and electrically conducting body 76 terminating at one end in wire or cable gripping portions, see at 77 and 78, and at the other and forwardly projecting end in a male inserting blade 80. It is also understood that, while capable of being uniquely configured with a suitable female terminal design and for a given assembly application, the male terminal 74 may also be provided as a stock item from a number of different manufacturers and for use with the female terminal configuration according to the present invention.

Figure 10A:
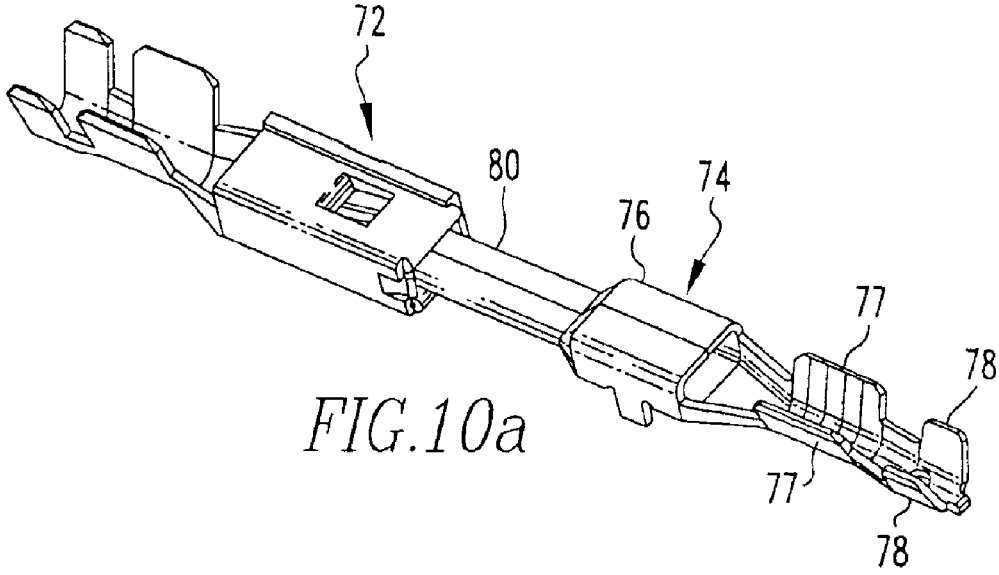
FIGS. 10A and 10B are perspective and cutaway schematic views of a progressive-engagement position established between the female terminal and an associated male terminal illustrated in FIGS. 9A and 9B.
Figure 10B:
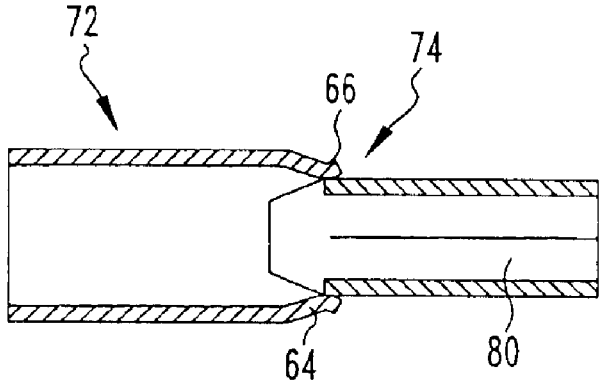

As further shown in FIGS. 10A and 10B, perspective and cutaway views are illustrated of an engagement position established between the female terminal 72 and associated and interengaged male terminal 74. In particular, the cross sectional cutaway of FIG. 10B illustrates the engagement of the tongue inserting end of the male blade 80 with the opposing and inwardly/laterally projecting contact tabs 64 and 66. As previously described, the tabs 64 and 66 operate to provide a sacrificial conduit for receiving the electrical and heat energy associated with an arcing event and to safeguard the integrity of the main electrical interface established between the angled and longitudinally extending beams of the female terminal. As further previously explained, it is understood that the configuration of the female terminal design, exhibiting one or more sacrificial and arc-locating contact tabs, is a focus of the invention and that such can further be provided either both with or without the Lorentz force inducing magnets.

Figure 11:
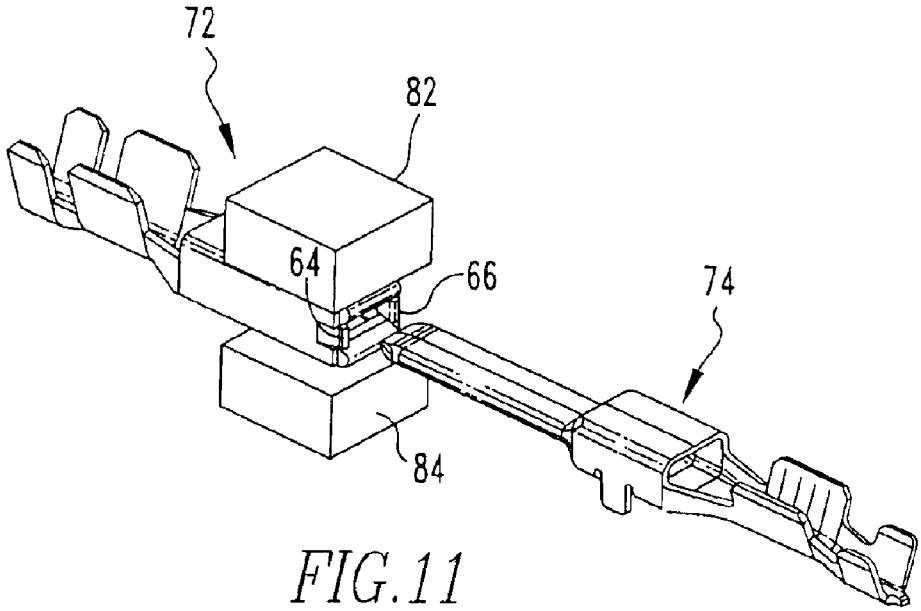
FIG. 11 is a pre-engagement view, similar to that shown in FIG. 9A, and illustrating the arc reducing magnets in place about the female terminal.
Figure 12:
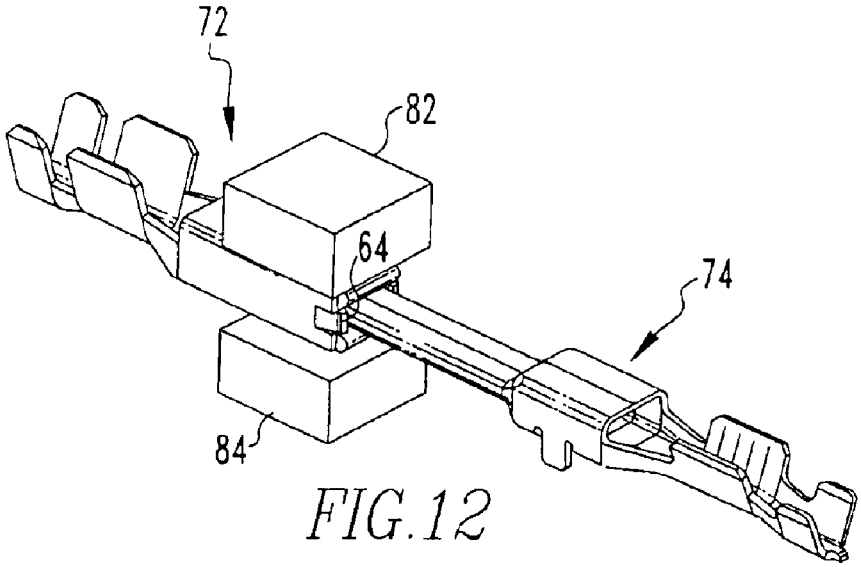
FIG. 12 is a progressive engagement view, similar to that shown in FIG. 10A, and again illustrating the position of the arc reducing magnets according to the present invention.

Referring now to FIGS. 11 and 12, illustrated are both pre-engagement and progressive engagement views of the female and male terminals, and further illustrating the positioning of arc reducing magnets 82 and 84 in place about the female terminal. In particular, the magnets 82 and 84 are placed in relation to a forward most end of the female terminal 72, proximate the open inserting end and the location of the initial contact tabs 64 and 66.

As further previously explained, it is desirable that the attracting magnets 82 and 84 be placed as close together as is possible and in order that a maximum Lorentz force arcing path (as previously illustrated and described in FIG. 2) be created. In this manner, the electromagnetic arcing path thus created will serve the initial function of dissipating some of the excessive electrical energy between the male and female terminals, and by virtue of the lengthened flow path. Further, and at the point at which an arcing event is inevitable and will occur, the manner and location in which the magnets are positioned will further serve to facilitate the arcing event in proximity to the initial contact tabs 64 and 66 and to thus further segregate the electrical arcing at the tabs 64 and 66 and to again safeguard the main electrical interface within the female terminal interior.

Figure 13:
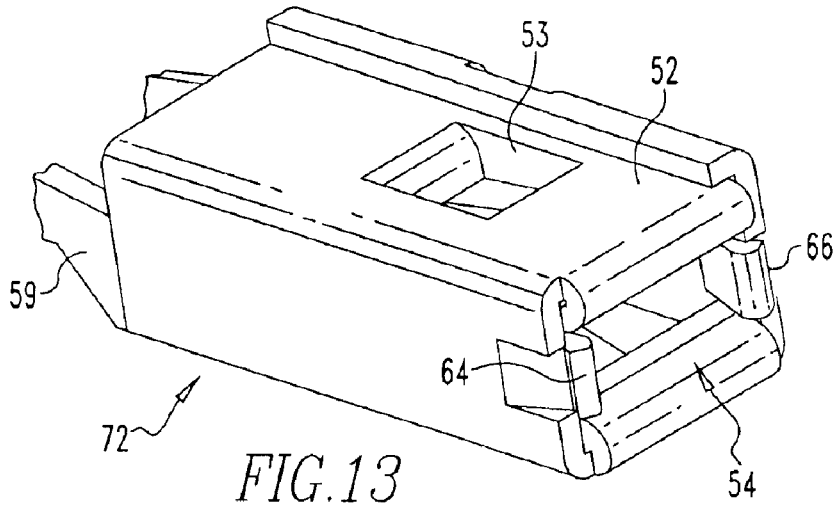
FIG. 13 is a substantial duplicate of FIG. 8 and again illustrating an enlarged perspective view of the open insertion end associated with the female terminal according to the present invention.
Figure 14A:
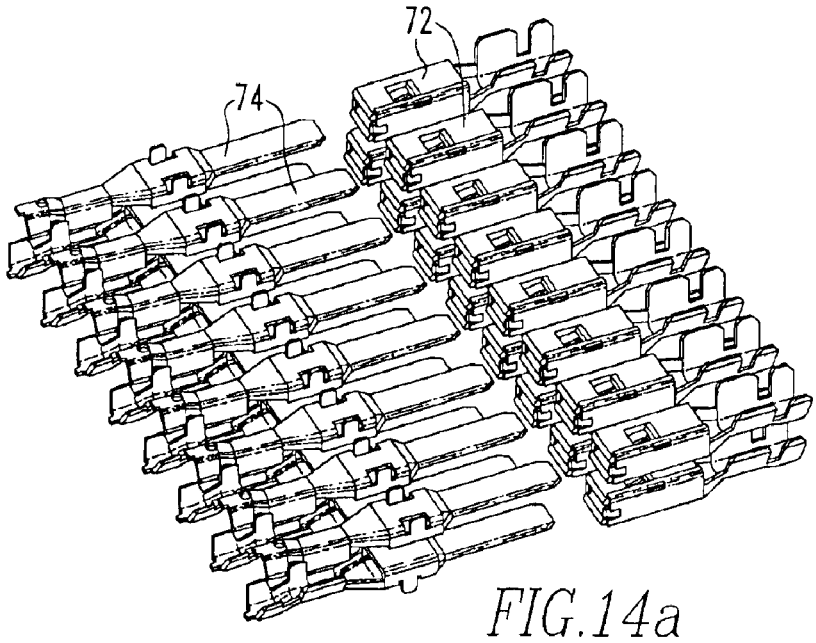
FIGS. 14A and 14B are perspective and cutaway schematic views of a pre-engagement position established between the female terminal and an associated male terminal according to a 16 way connector terminal array according to a further preferred embodiment of the present invention.
Figure 14B:
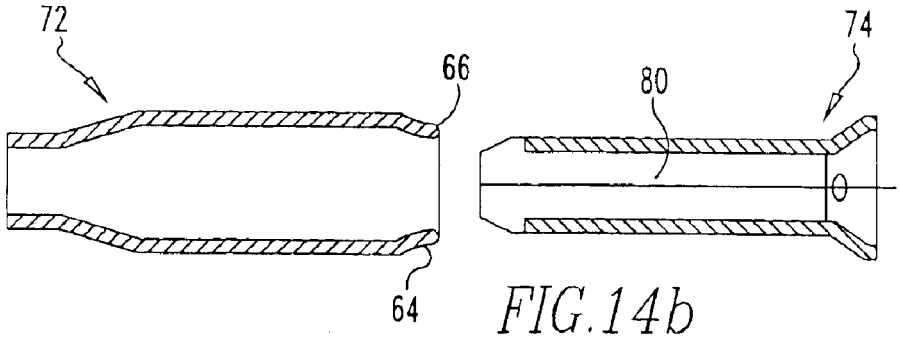
Figure 15A:
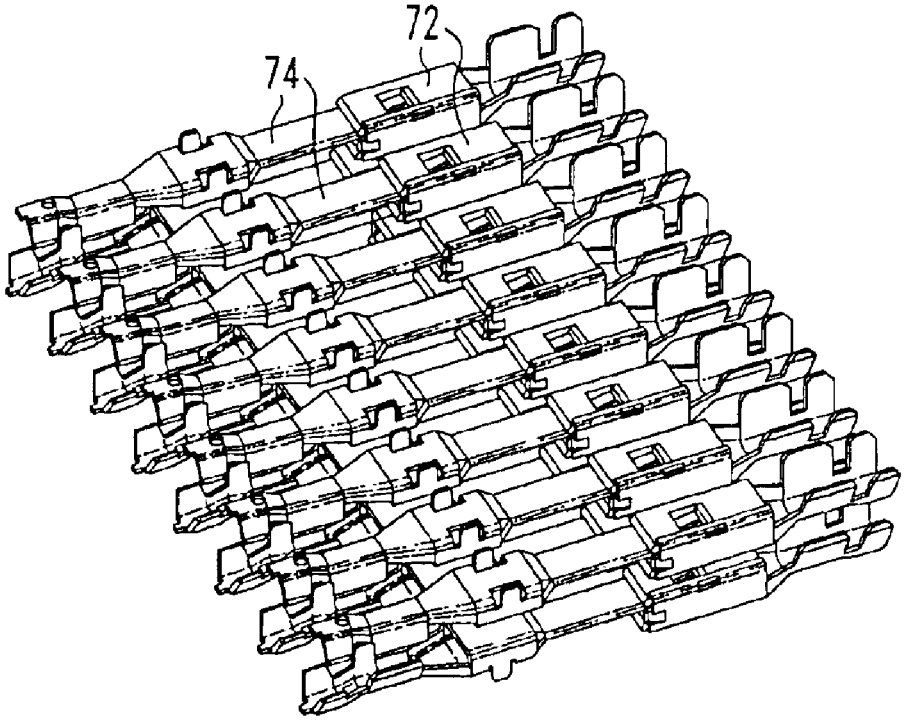
FIGS. 15A and 15B are perspective and cutaway schematic views of a progressive-engagement position established between the multiple female terminal and an associated male terminal array illustrated in FIGS. 14A and 14B.
Figure 15B:
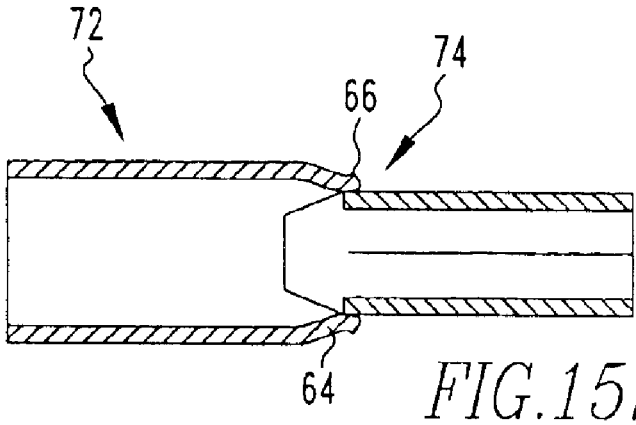

Referring now to FIG. 13, a substantial duplicate of the illustration of FIG. 8 is again shown of the female terminal and such that a repetitive description thereof is unnecessary. Referring further to FIGS. 14A and 14B, both perspective and cutaway views of a pre-engagement position established between a selected female terminal (such as previously described at 72) and an associated male terminal (and further such as previously described at 74) are illustrated and according to a 16 way connector terminal array in a further preferred embodiment of the present invention.

The pre-engagement illustrations of FIGS. 14A and 14B, in addition to the progressive engaging position of FIGS.

Figure 16:
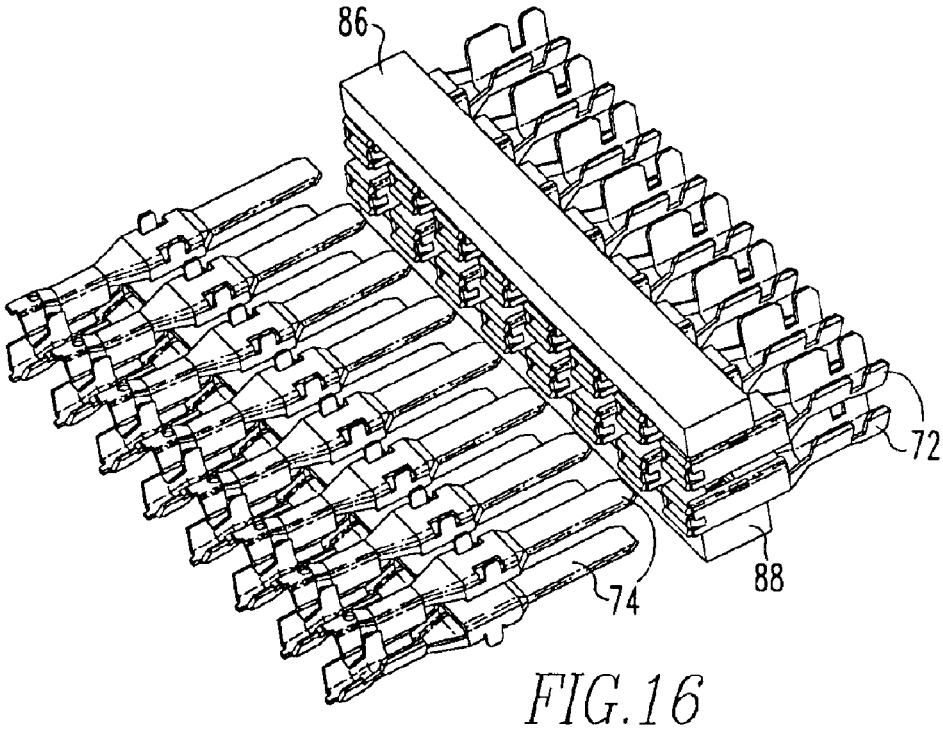
FIG. 16 is a pre-engagement view, similar to that shown in FIG. 14A, and illustrating the arc reducing magnets in place about the multiple female terminal array.
Figure 17:
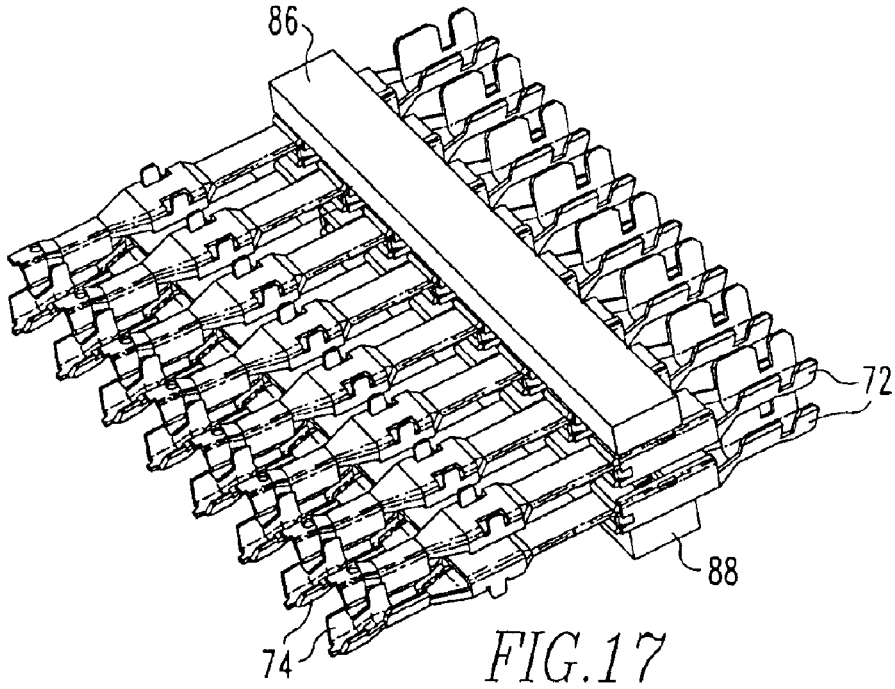
FIG. 17 is an initial and proceeding engagement view, similar to that shown in FIG. 15A, and again illustrating the position of the arc reducing magnets according to the present invention.

15A and 15B, illustrate identically configured female 72 and interengageable male 74 terminals, such that additional and repetitive description is unnecessary, and in a multiple arrayed fashion (again a "16" way array as previously stated). Referring further to FIGS. 16 and 17, both pre-engagement and progressive-engagement views are again shown of the multiple terminal array and which further illustrate arc reducing magnets 86 and 88 in place about the multiple female terminal array.

The magnets 86 and 88 are similar in nature to those previously shown at 82 and 84 in FIGS. 11 and 12, except that they are elongated to accommodate the multiple arrays of female 72 and male 74 interengageable terminals. It is further the purpose of these illustrations to exemplify one possible multiple/plural arrangement of female/male terminals and it is further understood that any given multiple arrangement of interengageable terminals can be incorporated according to the present invention. The orientation of male and female terminals is conventionally known, therefore any modifications of such existing connection systems, in particular the installation of the magnets, is minimized.

Figure 18:
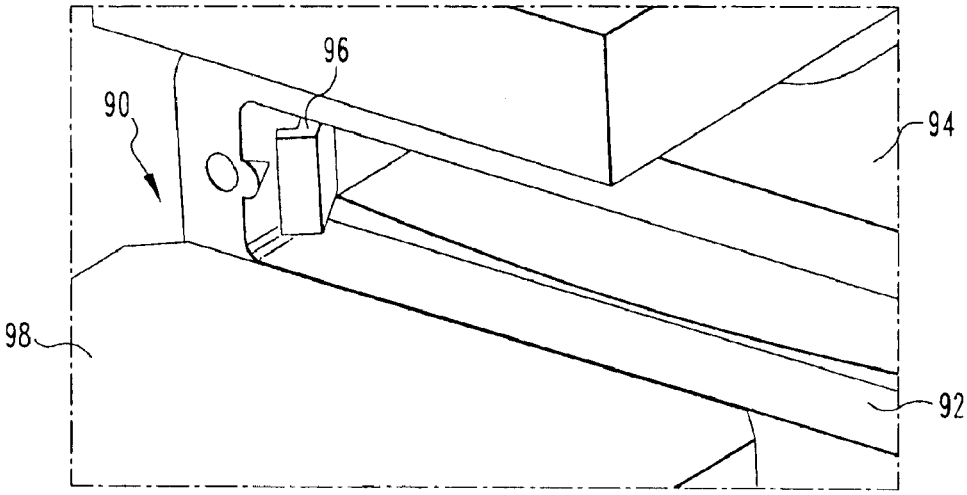
FIG. 18 is an enlarged perspective view of the open insertion end associated with a rectangular female terminal and which illustrates a single male blade engaging contact tab according to a further preferred embodiment of the present invention.

FIG. 18 is an enlarged perspective view 90 of an open insertion end 92 associated with a rectangular female terminal 94 and which further illustrates a single male blade engaging contact tab 96 according to a further preferred embodiment of the present invention. As previously explained, it is possible that a single contact tab, or any plurality of contact tabs, can be incorporated into the design of the female terminal 94 and within the scope of the invention.

Figure 19A:
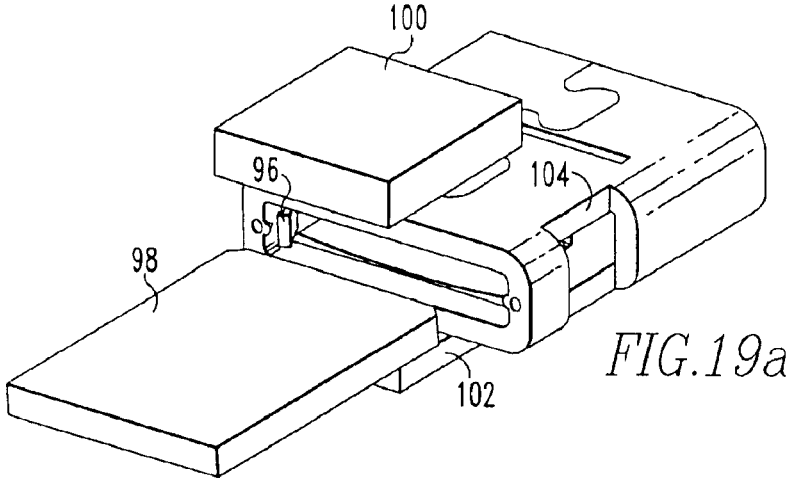
FIGS. 19A and 19B are perspective and cutaway schematic views of a pre-engagement position established between the female terminal in FIG. 18 and an associated male terminal according to the present invention and with the arc reducing magnets in place about the female terminal in proximity to the inserting end location.
Figure 19B:
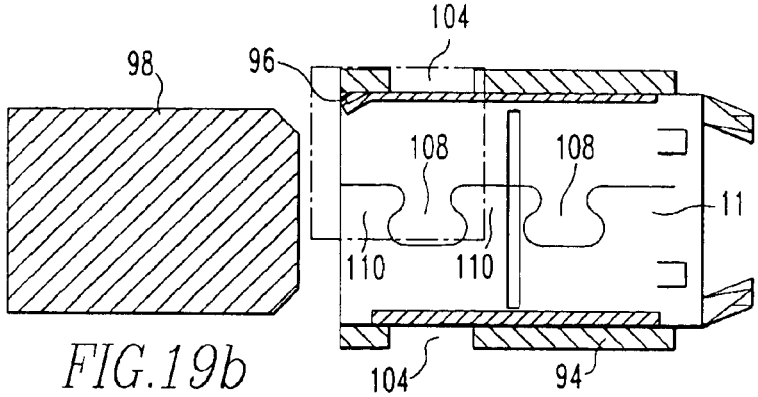

As is also illustrated in the perspective and cutaway views of FIGS. 19A and 19B, a male inserting blade 98 is illustrated in position proximate the female open inserting end 92 and also shown are a pair of arc reducing magnets 100 and 102 in place about the female terminal in proximity to the inserting end location. Additional features associated with the female terminal 94 include the provision of side positioned locking windows, see at 104 and again for the purpose of being engaged by suitable structure extending from the associated male terminal (not shown).

Figure 20A:
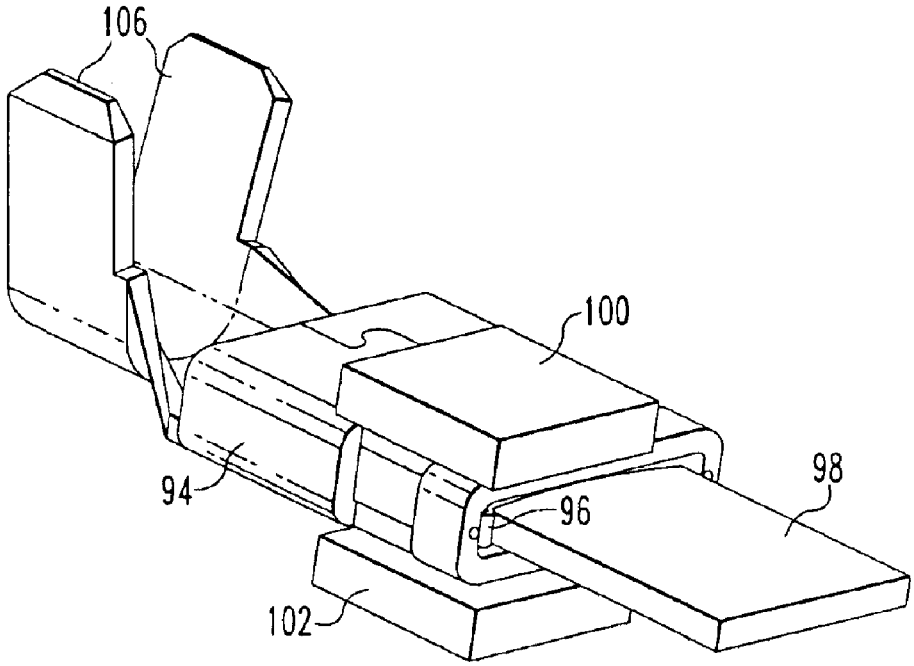
FIGS. 20A and 20B are perspective and cutaway schematic views of a progressive engagement position established between the female terminal and an associated male terminal illustrated in FIGS. 19A and 19B.

Additionally, configured gripping tabs 106, see in particular in FIG. 20A are shown and for engaging the extending end of an associated wire or cable (not shown). Further, and referring to the side cutaway views of FIGS. 19B and 20B, interlocking keystone portions 108 and 110 are provided along a top surface of the female terminal 94 and, upon being compressed, facilitate the mechanical holding and compressing forces of an interiorly configured spring cage (not shown) relative to the male inserting blade 98.

Figure 20B:
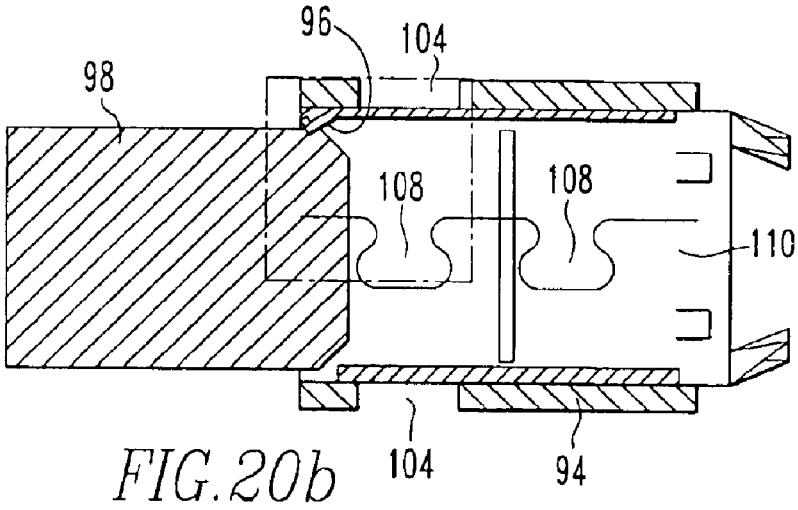
Figure 21:
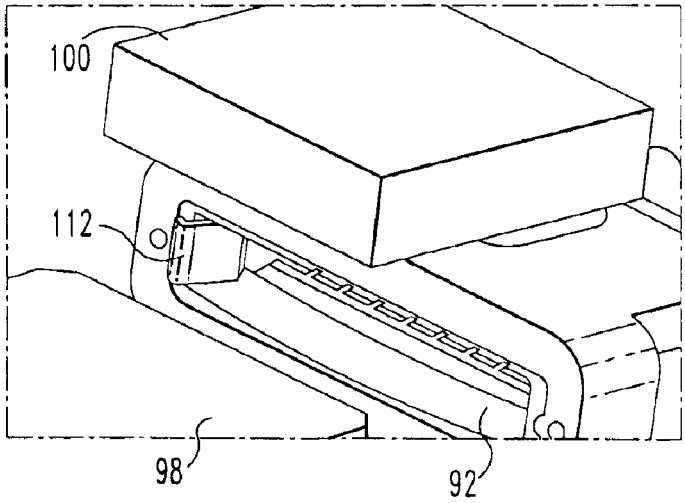
FIG. 21 is a view substantially identical to that previously illustrated in FIG. 18 and with the exception of an alternatively configured engagement tab according to the present invention.
Figure 22A:
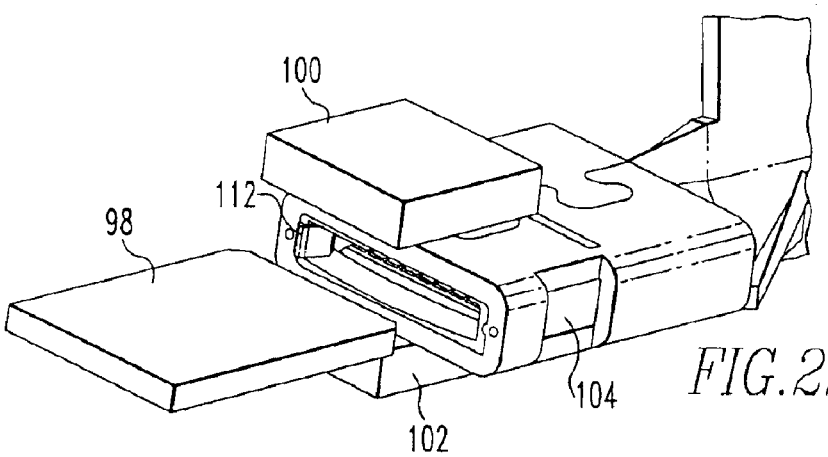
FIGS. 22A and 22B are perspective and cutaway schematic views, similar to that previously illustrated in FIGS. 19A and 19B, respectively, and further showing the alternatively configured engagement tab relationship of FIG. 21.
Figure 22B:
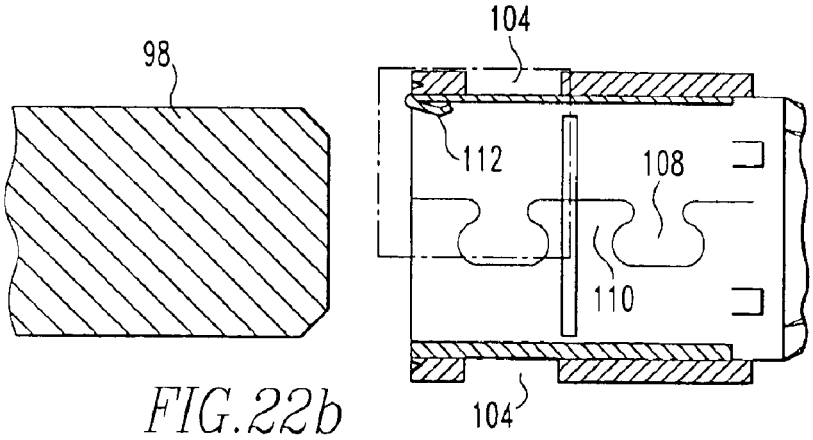
Figure 23A:
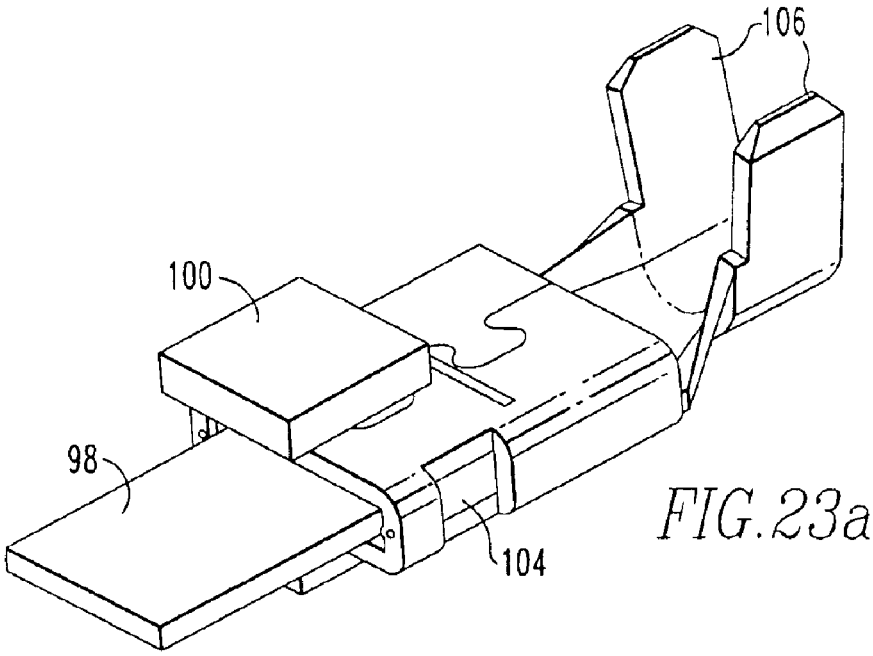
FIGS. 23A and 23B are perspective and cutaway schematic views, similar to that previously illustrated in FIGS. 20A and 20B, respectively, and showing the manner of engagement of the male blade with the female terminal as also shown in FIGS. 22A and 22B.
Figure 23B:
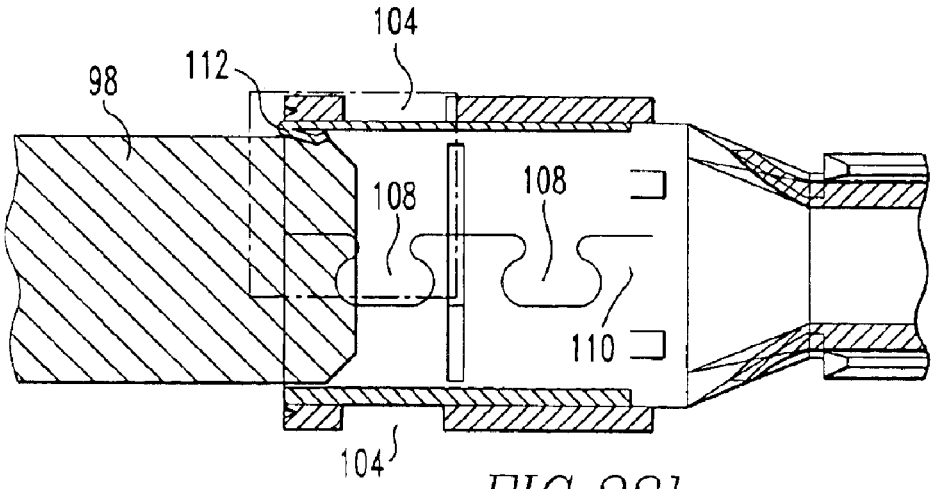

FIGS. 20A and 20B, in similar fashion to several of the preceding described embodiments, illustrate perspective and cutaway views, respectively, of a progressive engagement established between the female terminal 94 and associated male terminal (blade 98) as illustrated in FIGS. 19A and 19B. It is also important to note that the inserting illustration as best shown in FIG. 20B does not necessarily represent the final inserting position of the male blade 98 relative to the open interior of the female terminal 94, rather it is primarily intended to identify the initial contact (or pre/post contact) position of the blade 98 relate to the female tab 96 and at which an arcing event is likely to occur.

Also, it is worth pointing out here that the male terminal blades, in any of the several preceding embodiments, will arc along their side extending edges, due to the configuration and placement of the initial/sacrificial contact tabs associated with the female terminals. In this fashion, it is intended that the attendant damage to the male terminal blades be likewise limited, and as opposed to the arcing event occurring across the planar face or faces of male blades, which would further again result in substantial damage or destruction to the main electrical interface existing between the faces of the blade and the associated beams of the female terminal.

FIGS. 21, 22A & 22B, and 23A & 23B illustrate a rectangular male to female terminal assembly virtually identical to that illustrated and described in reference to FIGS. 18, 19A & 19B, and 20A & 20B, and with the exception of a modified configuration of a single initial contact tab 112 and in substitution of that previously described and identified at 96. The tab 112 in this variant is presented as a rearwardly and inwardly directed tang portion, and opposite to the forwardly and inwardly projecting direction of the tab 96 in the previous variant. Accordingly, and again, a repetitive description of the elements common to both of these sub-variants is unnecessary.

Figure 24:
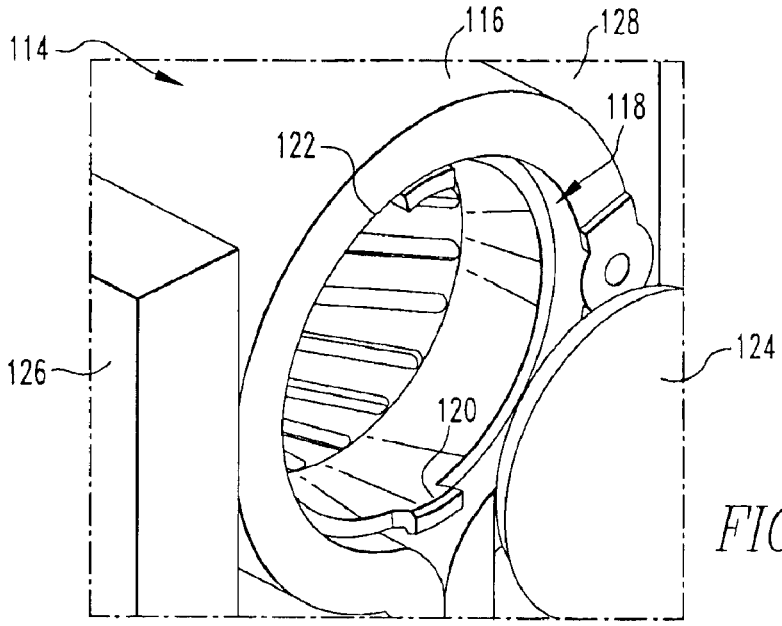
FIG. 24 is an illustration of an open inserting end of a rounded female terminal according to the present invention and which illustrates a single initial contact tab.
Figure 26A:
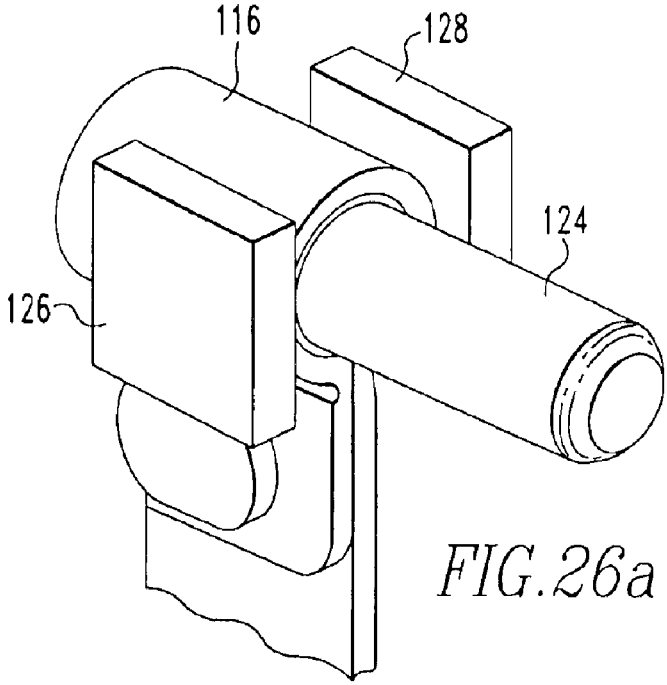
FIGS. 26A and 26B are perspective and cutaway schematic views of the progressive engagement position established between the female terminal and an associated male terminal illustrated in FIGS. 25A and 25B.
Figure 26B:
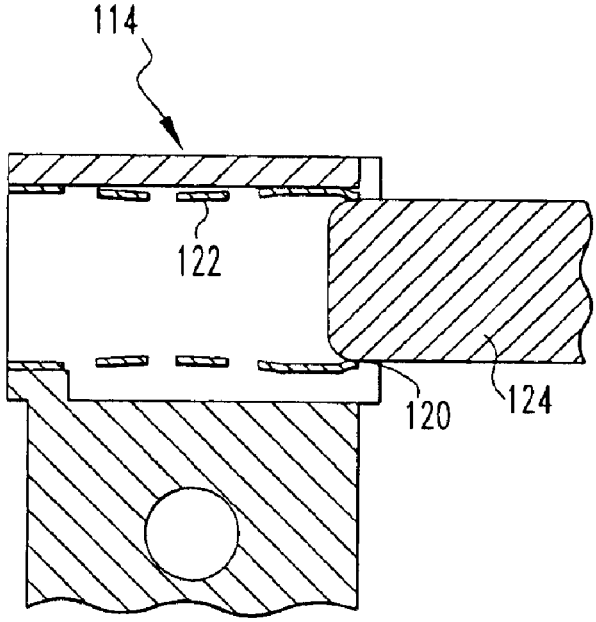

Finally, and now referring to FIG. 24, an illustration is provided at 114 of a rounded female terminal according to a still further variant of the present invention. The rounded terminal 114 includes a circular body 116, terminating in a forwardly directed and open inserting end 118. An initial contact tab 120 is illustrated and which extends from an interiorly held and substantially helix shaped spring cage 122 forming a part of the female terminal. As previously explained, any number of contact tabs 120 can be incorporated, ranging from one upwards, into the present design and the intention is that a leading inserting end of a rounded male inserting pin 124 come into initial contact for engagement or last contact for disengagement with the projecting tab 120 (see in particular cutaway of FIG. 26B) and thus electrically arc at that point and prior to completion of the inserting engagement or after completion of disengagement from main contact at which point the main electrical interface may be put in jeopardy.

Figure 25A:
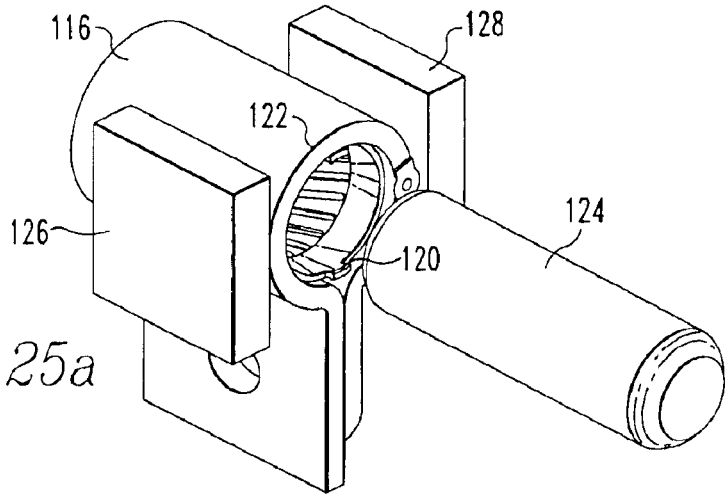
FIGS. 25A and 25B are perspective and cutaway schematic views of a pre-engagement or last engagement position established between the female 24 and an associated and round inserting male terminal according to the present invention.
Figure 25B:
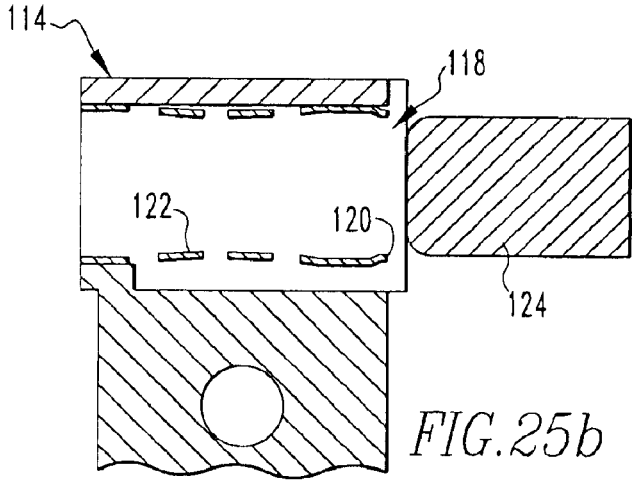

Referring again to FIGS. 25A and 25B, perspective and cutaway views are illustrated of both the pre-engagement or last engagement position established between the female terminal of FIG. 24 and the associated and round inserting male terminal. FIGS. 26A and 26B again are perspective and cutaway views of the progressive engagement position established between the female terminal and an associated male terminal and as previously explained.

All descriptions of the above paragraphs are applied to a disengagement situation, in which the tab(s) provide a last contact location during disengaging of the male and female terminals. The arcing is therefore localized on the tab(s) and the associated sides of the male terminal. Accordingly, it is not necessary to repeat the above described structure.

Having described our invention, it is evident that it discloses and teaches an improved female terminal design for initiating or limiting and localizing inevitable electrical arcing events at a forward and initial-engagement (or backward and disengagement, respectively) position and in order to safeguard a main electrical interface with an inserting (or disengaging) male terminal. The present invention further provides an improved assembly which, when utilized along with Lorentz force producing magnets, both increases the threshold at which an arcing event will occur (again by increasing the energy necessary to arc as a result of the establishing of the arcing path by the magnets) and again by localizing the arcing event at the forward initial engagement (or backward disengagement) end of the terminals.

The present invention accordingly also reduces the damage at the forward inserting (or disengagement) end of the female terminal by attempting to localize the same to the sides of the terminal, as well as along the corresponding and narrowed side edges of the male inserting blade (and not its top and bottom faces). Furthermore, the incorporation of the modified female terminal design (with or without the Lorentz force inducing magnets) can be accomplished without any major modifications to existing terminal systems and is additionally compatible with existing male connectors in either singular or multiple terminal arrangements. The tab(s) again also provide small area(s) upon which are applied any of a varying number of cost-effective coatings such as nickel or ceramics, among others. These coatings further help to reduce arcing damage.

Additional preferred embodiments will become apparent to those skilled in the art to which it pertains and without deviating from the scope of the appended claims.

What is claimed is:

1. A female terminal for use with a male terminal in establishing an electrical power connection, said female terminal comprising:

a main connector body having an open inserting end for receiving an inserting portion of the male terminal and an interior location for establishing a main electrical interface between said male terminal and said female terminal, said interior location comprising elongated, twisted, curved and angled beams extending along opposing interior faces of said main connector body and along said main electrical interface;

the main connector body having at least one tab proximate to said open inserting end of the main connector body and distal from said interior location of the main connector body, said at least one tab being contacted by the male inserting portion and prior to or subsequent of achieving said main electrical interface wherein upon an occurrence of an electrical arcing event between the male and female terminals, an energy flow resulting from said arcing event traveling from said male terminal through said at least one tab at a location remote from said main electrical interface for both said male and female terminals.

2. The female terminal as described in claim 1, said at least one tab further comprising an angled and electrically connected tang portion.

3. The female terminal as described in claim 1, said at least one tab further comprising a plurality of angled, twisted and electrically connected tang portions arranged at specified locations along said open inserted end.

4. The female terminal as described in claim 1, said main connector body further comprising a rounded and cylindrical shaped body, the male inserting portion further comprising a rectangular shaped inserting blade.

5. The female terminal as described in claim 1, said main connector body further comprising a rounded and cylindrical shaped body, the male inserting portion further comprising a rounded and cylindrical inserting pin.

6. The female terminal as described in claim 1, further comprising a pair of Lorentz force inducing magnets positioned on opposite facing sides of said main connector body and proximate said at least one tab at said open inserting end.

7. The female terminal as described in claim 6, further comprising multiple and interconnecting female and male terminals positioned between said magnets and according to a specified conventional array.

8. The female terminal as described in claim 1, further comprising an angled configurable blank into which is formed said female terminal.

9. The female terminal as described in claim 1, further comprising a pair of contact ribs extending in opposing fashion within said main connector body at said main electrical interface, said contact ribs providing against overstressing of said beams, as well as at least one rib providing current conducting through said female terminal.

10. The female terminal as described in claim 1, further comprising a coating of a material including at least one of a nickel, ceramic, silver and gold applied upon said at least one tab.

11. A female terminal for use with a male terminal in establishing an electrical power connection, said female comprising:

a main connector body having an open inserting end for receiving an inserting portion of the male terminal, a main electrical interface being established upon completed insertion of the male terminal and within an interior location of said female terminal;

at least one tab projecting from a location of said female terminal and proximate said open inserting end, said tab being contacted by the male inserting portion and prior to or subsequent of achieving said main electrical interface, said at least one tab further comprising a plurality of angled, twisted and electrically connected tang portions arranged at specified locations along said open inserted end; wherein upon the occurrence of an electrical arcing event between the male and female terminals, an energy flow resulting from said event traveling from said male terminal through said projecting tab and at a location remote from said main electrical interface for both said male and female terminals.

* * * * *

UNITED STATES PATENT AND TRADEMARK OFFICE

CERTIFICATE OF CORRECTION

PATENT NO. : 6,908,348 B2
APPLICATION NO. : 10/722995
DATED : June 21, 2005
INVENTOR(S) : Zhao et al.

It is certified that error appears in the above-identified patent and that said Letters Patent is hereby corrected as shown below:

On the Title Page, Item (75),
In the city of residence of the first inventor, delete "Allen Park" and insert --Canton--.
In the city of residence of the second inventor, delete "Allen Park" and insert --Fraser--.

In column 3, line 11, after "female", insert --terminal of FIG.--.

Signed and Sealed this

Sixth Day of November, 2007

JON W. DUDAS
*Director of the United States Patent and Trademark Office*